United States Patent [19]

Wolniak et al.

[11] Patent Number: 4,689,977

[45] Date of Patent: Sep. 1, 1987

[54] SWITCH LOCK WITH TWO MOMENTARY POSITIONS

[75] Inventors: Stanley C. Wolniak, Vernon Hills; Timothy P. Laabs, Des Plaines, both of Ill.

[73] Assignee: The Eastern Company, Naugatuck, Conn.

[21] Appl. No.: 889,738

[22] Filed: Jul. 28, 1986

Related U.S. Application Data

[63] Continuation-in-part of Ser. No. 646,790, Sep. 4, 1984, Pat. No. 4,633,689.

[51] Int. Cl.[4] ..... H01H 27/06; E05B 17/04

[52] U.S. Cl. ..... 70/379 R; 70/DIG. 30; 70/DIG. 72

[58] Field of Search ..... 70/252, 372, 373–374, 70/379 A, 379 R, 380, DIG. 36, DIG. 62; 200/61.64, 61.66, 61.67, 43.01, 43.02, 43.08, 43.11; 403/229

[56] References Cited

U.S. PATENT DOCUMENTS 4,427,852 1/1984 Wolniak et al. .

4,633,689 1/1987 Wolniak et al. .

*Primary Examiner*—Robert L. Wolfe

*Attorney, Agent, or Firm*—Wood, Dalton, Phillips, Mason & Rowe

[57] ABSTRACT

An actuating structure is provided for a lock having a barrel with a plug which is key-actuated for rotation therein, and a switch having a shaft and rotor rotatable with the plug. A first lug is fixed relative to the barrel and a second lug rotates with the plug. A first stop washer is provided having two slots therein, one slot receiving the first lug to allow limited rotation of the first washer relative to the barrel and the other slot receiving the second lug to allow limited rotation of the first washer relative to the plug. A second stop washer is also provided having two slots therein, one of the slots receiving the first lug to allow limited rotation of the second washer relative to the barrel and the other slot receiving the second lug to allow limited rotation of the second washer relative to the plug. A spring is provided to rotationally bias the stop washers in opposite directions.

17 Claims, 9 Drawing Figures

SWITCH LOCK WITH TWO MOMENTARY POSITIONS

CROSS-REFERENCE TO RELATED APPLICATION

This is a continuation-in-part application of Ser. No. 646,790, filed Sept. 4, 1984 and now U.S. Pat. No. 4,633,689 and entitled "Anti-Static Switch Lock With Momentary Position".

BACKGROUND OF THE INVENTION

1. Field of the Invention

This invention relates to a key-operated switch and more particularly to a switch lock having three positions, two of which are momentary.

2. Description of the Prior Art

Prior art anti-static switch locks are exemplified by U.S. Pat. No. 4,427,852 issued to Wolniak et al on Jan. 24, 1984. Locks of this type have a barrel which houses a rotatable, key-operated plug. The plug is suitably secured to a switch rotor, to rotate the rotor connecting the various terminals of a terminal assembly. A spring is provided to bias the lock toward one of its two positions.

In certain instances, however, it is desirable to have a key-operated switch with three positions where two of the positions are "momentary" (i.e. the switch lock is biased away from the momentary positions so that the lock will stay in either of those positions only so long as the key operator holds the key).

SUMMARY OF THE INVENTION

In one aspect of the invention, an actuating structure is provided for a lock having a barrel with a plug which is key-actuated for rotation therein, and a switch having a shaft and rotor rotatable with the plug. A first lug is fixed relative to the barrel and a second lug rotates with the plug. A first stop washer is provided having two slots therein, one slot receiving the first lug to allow limited rotation of the first washer relative to the barrel and the other slot receiving the second lug to allow limited rotation of the first washer relative to the plug. A second stop washer is also provided having two slots therein, one of the slots receiving the first lug to allow limited rotation of the second washer relative to the barrel and the other slot receiving the second lug to allow limited rotation of the second washer relative to the plug. A spring is provided to rotationally bias the stop washers in opposite directions.

In another aspect of the invention, the washer slots and the lugs are disposed so that the spring causes the plug to be biased toward a central maintaining position between two momentary positions, with the ends of the washer slots and the lugs interacting to hold the plug in the maintaining position when not turned by the operator. It is the object of the present invention to provide a simple, inexpensive and effective switch lock which has three positions, two of which are momentary.

DESCRIPTION OF THE PREFERRED EMBODIMENT

Figure 1:
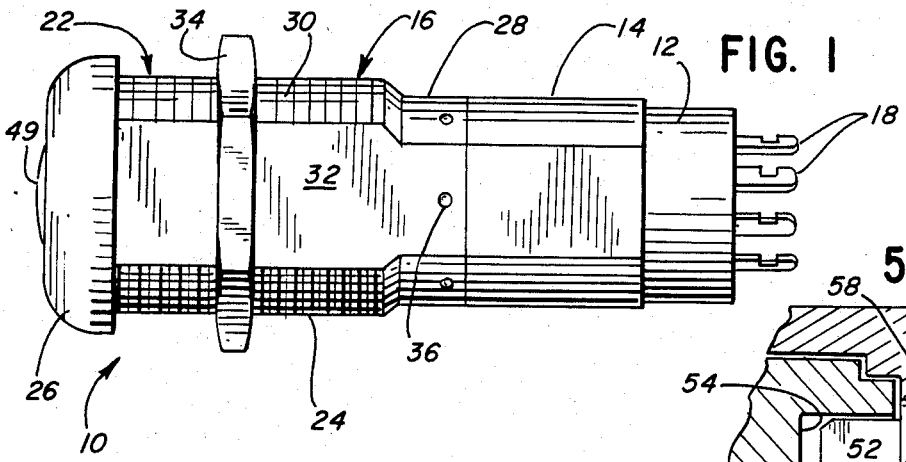
FIG. 1 is a side view of the assembled switch lock.

FIG. 1 illustrates the assembled switch lock 10 of the invention. Externally, this lock is substantially similar to known switch locks such as shown in, for example, U.S. Pat. No. 4,427,852. Specifically, the switch lock 10 includes a terminal assembly 12 mounted to a hub 14, the hub 14 in turn being secured to a key lock assembly 16.

The terminal assembly 12 does not form a part of the invention as described herein, and therefore only those parts and functions necessary for an understanding of the present invention will be set forth. The terminal assembly 12 (which is electrically insulated from the remainder of the switch lock 10) has a plurality of terminals 18 mounted thereon and houses a rotor (not shown). By turning an insulated, semi-circular shaft 20 (see FIG. 3) connected to the rotor, desired electrical connections between the terminals 18 may be effected. The terminals 18 are connected to the electric circuit for which the protection offered by the switch lock 10 is required.

It should be noted that various terminal assemblies 12 can be substituted for the four-terminal assemblies shown in the drawings depending upon the switching requirements between the terminals. Therefore, whenever the terminal assembly 12 is referred to, it is to be understood that the description is not to be limited to only the four-terminal assembly 12 illustrated.

To rotate the shaft 20 of the terminal assembly 12, the key lock assembly 16 is used. The key lock assembly 16 includes a barrel 22 consisting of a body 24 having an escutcheon 26 at one end and a barrel end 28 at the other end. The body 24 is cylindrical, having outer threads 30 interrupted by opposing flats 32 which, in cooperation with a nut 34, serve to mount the switch lock 10 to a panel board. The hub 14 is suitably secured to the barrel end 28, as by the indentations or stakes 36 into a groove 38 around the neck 40 on the hub 14, and includes two axial projections 42,44 received in slots 46,48 (see FIGS. 4A–C) to properly align the hub 14 and barrel end 28.

A rotatable lock plug 49 is received in the body 24 and has suitable tumblers or tumbler stops therein (not shown) so that the plug 49 may be turned within the barrel 22 only when a proper key is inserted therein. Such barrel and key plug assemblies are well known in the art and are illustrated in, for example, the above mentioned U.S. Pat. No. 4,427,852, the disclosure of which is hereby incorporated by reference.

Figure 2:
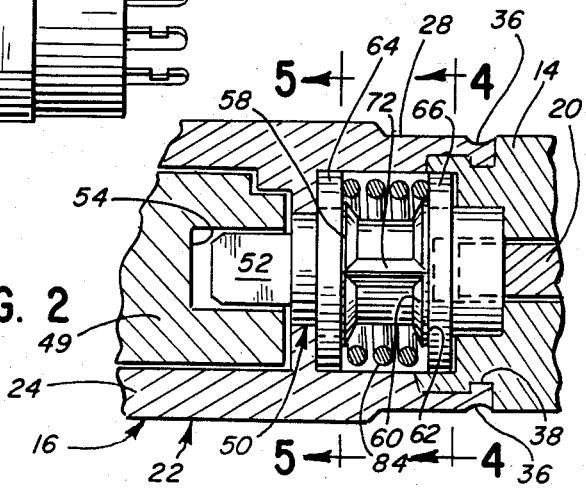
FIG. 2 is a fragmentary cross-sectional view of the switch lock showing the actuating structure.
Figure 3:
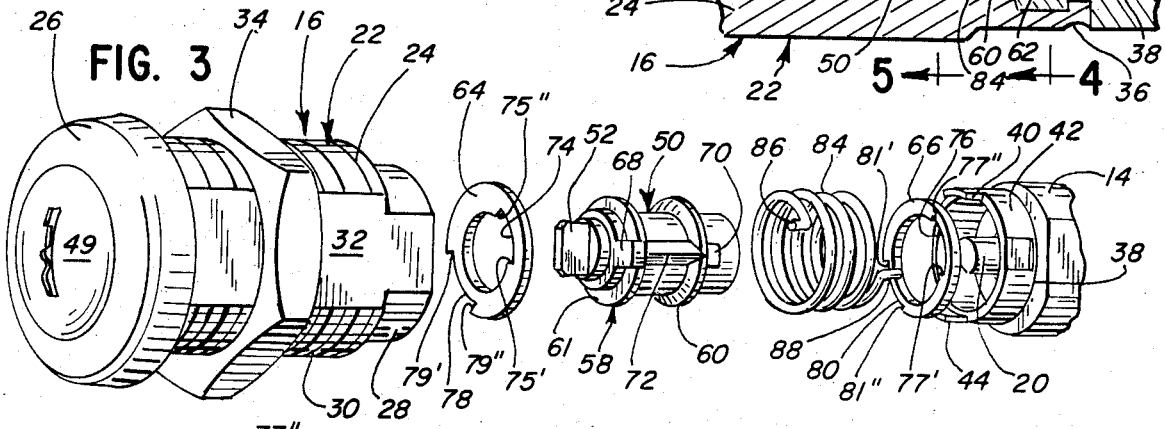
FIG. 3 is an exploded partial view of the switch lock.

FIG. 3 illustrates the interior components of the switch lock 10 in an exploded view. A coupling or actuating member 50 extends into recesses in the barrel end 28 and the terminal hub 14. A rectangular shaft 52 on one end of the actuator member 50 extends into a rectangular opening 54 (see FIG. 2) in the plug 49 so that the actuator member 50 and plug 49 rotate together. The semi-circular shaft 20 of the terminal assembly 12 extends into a semi-circular recess 56 (see FIGS. 4A–C) in the actuator member 50 so that the rotor of the terminal assembly 12 also rotates with the actuator member 50.

The actuator member 50 further includes a pair of annular flanges 58,60 defining oppositely directed, outwardly facing shoulders 61,62 against which two stop washers 64,66 are mounted. Radially outwardly projecting lugs or stops 68,70 are located on the actuator member 50 adjacent the flanges 58,60. A rib 72 is also provided between the flanges 58,60 of the actuator member 50. The two lugs 68,70 could be considered as a single lug cooperating with both stop washers 64,66, though it should be understood that the lugs 68,70 need not be aligned with one another.

The two stop washers 64,66 are basically identical, including an inner slot 74,76 (within which is received the respective outwardly projecting lug 68,70) with opposite end surfaces 75',75",77',77" and an outer slot 78,80 with opposite end surfaces 79',79",81',81". As will become apparent, these stop washers 64,66 and their associated slots 74,76,78,80 cooperate to secure the switch lock 10 in a maintaining position and also allow the lock 10 to be turned to two different momentary positions.

A wound coil torsion spring 84 extends between the stop washers 64,66 and has opposite ends 86,88 which are received in the outer slots 78,80 of the stop washers 64,66 and bias against one end surface 79",81" in each to create a torsional bias between the washers 64,66. The actuator member rib 72 acts to center the spring 84 thereon.

One end of each outer slot 78,80 may be angled so that the spring ends 86,88 tend to stay within the slots 78,80 (and identical washers 64,66 may be manufactured, even though the angles must be in opposite end surfaces 79",81" of the slots 78,80, by simply using washers 64,66 which are reversed relative to one another).

The length of the slots 74,80 can be chosen according to the amount of turn desirable to properly operate the terminal assembly 12, as will become apparent.

A radially inwardly projecting lug or stop 90 (see FIGS. 4A–C and 5A–C) is also provided within the barrel end 28. This lug 90 is received in the outer slots 78,80 of both stop washers 64,66.

It should be understood that the disclosed embodiment is merely exemplary, and that other structures providing a suitable inwardly projecting lug 90 could be used. For example, the lug could be a part of the hub 14, or could be a separate piece mounted within the barrel end 28 and terminal hub 14, or could even be two different parts, one in the barrel end 28 and one in the terminal hub 14.

The operation of the switch lock 10 can be seen in FIGS. 4A–C and 5A–C. The switch lock 10 operates with one maintaining position which is between two momentary positions. That is, when a key is inserted into the lock plug 49, it may be turned either clockwise or counterclockwise to either of two momentary positions. When an operator releases the key while the lock 10 is in one of the momentary positions, the lock 10 is automatically returned to the central maintaining position. The tumbler splines (not shown) are such that the key may be removed from the lock plug 49 when the switch lock 10 is in the maintaining position so that the key operator can lock the switch lock 10 to prevent an unauthorized user from placing the switch lock in either of the momentary positions.

The individual components providing the above described operation are illustrated in the various positions in FIGS. 4A–C and 5A–C. It should be kept in mind that each of these figures view the components in the direction opposite from that which an operator would view the lock 10, so that an operator turning the key clockwise turns the attached actuator member 50 counterclockwise in FIGS. 4A–C and 5A–C and vice versa.

It should also be recalled that the key plug 49, actuator member 50 and rotor of the terminal assembly 12 are all interconnected for rotation together, and references hereafter to rotation of the actuator member 50 (which is the component seen in FIGS. 4A–C and 5A–C) necessarily also mean that the key plug 49 and terminal assembly rotor are rotated as well. Therefore, the reader should not be misled by references to the operator "turning the actuator"; the operator actually turns the key plug 49 with the key and the actuator member 50 is turned with it. Further, the reader should keep in mind that while reference will be made to rotation of the actuator member 50, the significance of this is that the terminal assembly rotor is turned to change the electrical connection of the terminals 18.

Figure 4A:
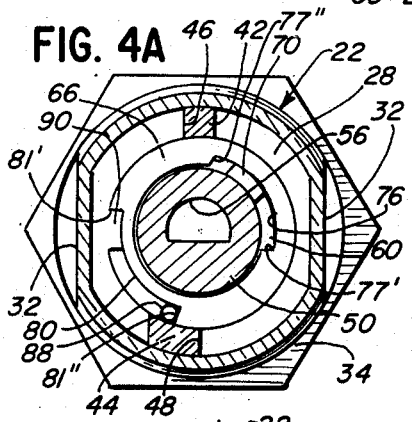
FIGS. 4A–C are cross-sectional views taken along line 4—4 in FIG. 2 showing the lock in one momentary position, the maintaining position, and a second momentary position, respectively.
Figure 4B:
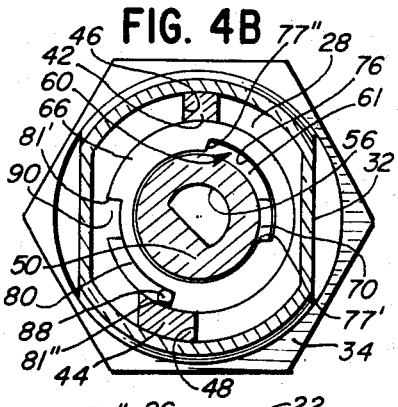
Figure 5A:
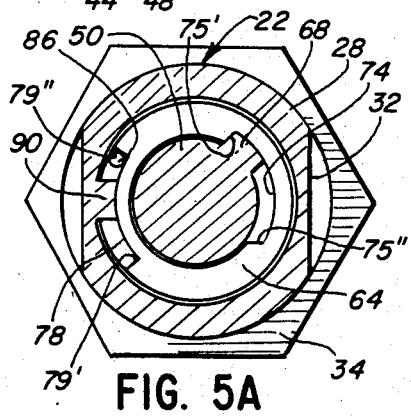
FIGS. 5A–C are views taken along line 5—5 of FIG. 2 showing the lock in one momentary position, the maintaining position, and a second momentary position, respectively.
Figure 5B:
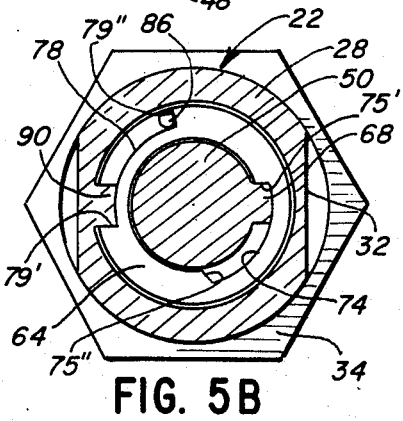

Reference will first be had to the central maintaining position which is illustrated in FIGS. 4B and 5B. As shown in FIG. 4B, one stop washer 66 is biased in a counterclockwise direction by the spring end 88 in the outer slot 80. The opposite end surface 81' of the outer slot 80 engages the lug 90 to limit counterclockwise rotation so that the stop washer 66 is held in the position shown. The lug 70 on the actuator member 50 abuts one end surface 77' of the inner slot 76 so that clockwise rotation of the actuator member 50 is prevented beyond the position shown. As shown in FIG. 5B, the other stop washer 64 is biased in the clockwise direction by the spring end 86 and is held in the position shown by the abutment of one end surface 79' of the outer slot 78 with the lug 90. The lug 68 on the actuator member 50 is received in the inner slot 74 of the stop washer 64 so that the actuator member 50 is limited by the end surface 75' against counterclockwise rotation beyond the position shown in FIG. 5B.

Accordingly, in the maintaining position illustrated in FIGS. 4B and 5B, the two stop washers 64,66 are held in the positions illustrated by the spring 84. Further, the actuator member 50 is limited against clockwise rotation by the stop washer 66 and against counterclockwise rotation by the stop washer 64 so that the actuator member 50 is maintained in the position shown.

If an operator inserts a key into the plug 49 and turns the plug clockwise, the actuator member 50 is correspondingly turned counterclockwise as illustrated in FIGS. 4A and 5A to one of the momentary positions. Specifically, the force exerted by the operator will cause the actuator member 50 and its connected lug 68 to move the stop washer 64 counterclockwise against the bias of the spring end 86. The outer slot 78 allows the stop washer 64 to travel past the lug 90 so as to permit counterclockwise rotation of the stop washer 64. At the same time, the stop washer 66 (as shown in FIG. 4A) remains in the position it has in the maintaining position, and its inner slot 76 allows the actuator member 50 and its lug 70 to freely move in a counterclockwise direction relative to the stop washer 66 through the desired angle to one momentary position.

Once the key operator releases the key, the spring end 86 will bias the end surface 79" of the stop washer 64 to return the washer to the position shown in FIG.

5B, and will further carry the actuator member 50 and its lug 68 so that the actuator member 50 is returned to its maintaining position.

Figure 4C:
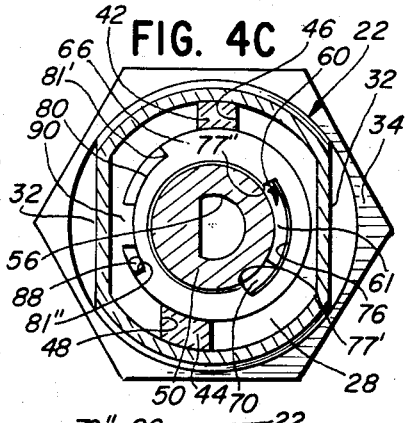
Figure 5C:
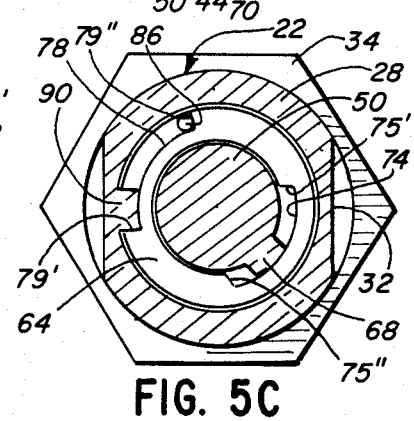

The switch lock 10 can also be turned to its other momentary position by the action of a key operator turning the plug counterclockwise from the maintaining position. Specifically, counterclockwise rotation of the plug 49 causes the actuator member 50 to turn clockwise as illustrated in FIGS. 4C and 5C. Clockwise rotation of the actuator member 50 causes its lug 70 to engage the end surface 77' of the inner slot 76 of one stop washer 66 and to rotate that stop washer 66 clockwise against the bias of the spring end 88. At the same time, as illustrated in FIG. 5C, the other stop washer 64 remains in the same position, but that stop washer 64 does not hinder clockwise rotation of the actuator member 50 inasmuch as the lug 68 moves freely in the inner slot 74. As with the other momentary position, when the key operator releases the force applied to turn the switch lock 10 to the momentary position shown in FIGS. 4C and 5C, the spring end 88 biases the stop washer 66 counterclockwise to return it to the position shown in FIG. 4B, and the inner slot 76 of the stop washer 66 at the same time acts on the lug 70 to return the actuator member 50 to the maintaining position.

In summary, the switch lock provides an operation whereby the lock 10 and associated terminal assembly rotor are maintained in a central (usually "off") maintaining position. An operator can use an appropriate key to turn the switch lock 10 either clockwise from the maintaining position to a first momentary position or counterclockwise from the maintaining position to a second momentary position, thereby positioning the associated terminal assembly rotor in one of two different momentary positions. When the operator releases the key, the switch lock will be automatically returned to its central maintaining position from either momentary position.

Other aspects, objects and advantages of the invention can be obtained from a study of the drawings, the specification and the appended claims.

We claim:

1. In a key operated switch including a lock having a barrel and rotatable plug with key actuated tumblers and a switch having a rotatable shaft, an improved switch actuator comprising:

an actuator member interconnecting the rotatable plug and the rotatable shaft;

first and second rotatable stop washers about the actuator member;

means for rotationally biasing the first and second stop washers in opposite directions;

a surface on the first stop washer which engages the actuator member upon rotation of the plug in one direction from a first position to a second position to rotate the first stop washer against the action of the biasing means;

a surface on the second stop washer which engages the actuator member upon rotation of the plug in the other direction from the first position to a third position to rotate the second stop washer against the action of the biasing means;

means for maintaining the first and second stop washers against the action of the biasing means in an orientation corresponding to the first position;

means associated with the first stop washer for allowing rotation of the actuator member in the other direction independently of the first stop washer to turn the switch from the first to the third position; and means associated with the second stop washer for allowing rotation of the actuator member in the one direction independently of the second stop plate to turn the switch from the first to the second position.

2. The switch of claim 1, wherein the first and second stop washer surfaces are radial and are adapted to engage lugs projecting radially outwardly from the actuator member.

3. The switch of claim 2, wherein each of the washer surfaces define an end to an annular slot within the inner periphery of the associated stop washer.

4. The switch of claim 3, wherein the means for allowing rotation comprise an annular slot in the outer periphery of each stop washer and the securing means comprises a lug associated with the barrel and adapted to engage an end of the outer slots of both the first and second stop washers.

5. The switch of claim 1, wherein the means for allowing rotation comprise an annular slot in the outer periphery of each stop washer and the securing means comprises a lug associated with the barrel and adapted to engage an end of the outer slots of both the first and second stop washers.

6. The switch of claim 1, wherein the biasing means comprises a torsion spring between the first and second stop washers.

7. The switch of claim 6, wherein opposite ends of the torsion spring are received in the outer slots in the first and second stop washers, respectively.

8. In a key-operated switch including a lock having a barrel and rotatable plug with key-actuated tumblers and a switch having a shaft rotatable with the plug, an improved switch actuator comprising:

a first lug fixed relative to the barrel;

a second lug adapted to rotate with the plug;

a first stop washer having first and second slots therein, said first washer first slot receiving said first lug to allow limited rotation of the first washer relative to the first lug and said first washer second slot receiving said second lug to allow limited rotation of the first washer relative to the second lug;

a second stop washer having first and second slots therein, said second washer first slot receiving said first lug to allow limited rotation of the second washer relative to the first lug and said second washer second slot receiving said second lug to allow limited rotation of the second washer relative to the second lug; and means for rotationally biasing the first and second stop washers in opposite directions.

9. The switch of claim 8, wherein the biasing means comprises a torsion spring between the first and second stop washers.

10. The switch of claim 8, wherein the lugs and slots are disposed so that end surfaces of the first slots engage opposite sides of the first lug and end surfaces of the second slots engage opposite sides of the second lug so as to define a maintaining position.

11. The switch of claim 8, wherein an actuator member connects the plug and switch and the first and second stop washers are disposed around the actuator member.

12. The switch of claim 11, wherein the second lug is fixed to the actuator member and extends radially outward therefrom, and said first and second washer second slots are in the inner periphery of the washers.

13. The switch of claim 12, wherein the first lug extends radially inwardly toward the actuator member, and the first and second washer first slots are in the outer periphery of the washers.

14. In a key-operated switch including a lock having a barrel and rotatable plug with key-actuated tumblers and a switch having a rotatable shaft, an improved switch actuator comprising:

an actuator member connecting the plug and switch for rotation together, said actuator member including first and second outwardly projecting stops;

first and second inwardly projecting stops in the barrel;

a first stop washer disposed over said actuator member with a first arcuate inner slot receiving the first outwardly projecting stop and a first arcuate outer slot receiving the first inwardly projecting stop;

a second stop washer disposed over said actuator member with a second arcuate inner slot receiving the second outwardly projecting stop and a second arcuate outer slot receiving the second inwardly projecting stop; and means for rotationally biasing the first and second stop washers in opposite directions.

15. The switch of claim 14, wherein the biasing means comprises a torsion spring between the first and second stop washers.

16. The switch of claim 15, wherein opposite ends of the torsion spring are received in outer slots of the first and second stop washers, respectively.

17. In a key-operated, bi-directional, momentary switch having a lock barrel, a key receiving plug rotatable in said barrel, and a switch connected with said barrel and having a rotor with a shaft, the improvement comprising:

an actuator member connecting the plug and the shaft;

a pair of stop washers on said actuator member;

cooperating surfaces on said actuator and said stop washers which engage to rotate one of the stop washers with clockwise actuator member rotation and to rotate the other of the stop washers with counterclockwise actuator member rotation; and a coil spring urging the stop washers in opposite directions to hold the actuator member in a maintaining switch position, the spring being wound up by rotation of the plug and actuator in either direction from said maintaining position.

* * * * *